United States Patent [19]

Kelly et al.

[11] Patent Number: 4,742,951

[45] Date of Patent: May 10, 1988

[54] CONTAINER FOR BULK FLOWABLE MATERIALS

[75] Inventors: Stuart Q. Kelly, Camden; Geoffrey M. Maguire, Rosemeadow; Craig Holland, St. Marys; Kevin R. Duell, Montrose; Geoffrey Clark, Berwick; John E. Jones, Boronia Park; Kenneth Green, Blaxland; Gregory N. Ryan, Linden, all of Australia

[73] Assignee: Visy (U.K.) Ltd., England

[21] Appl. No.: 841,584

[22] Filed: Mar. 20, 1986

[30] Foreign Application Priority Data

Mar. 22, 1985 [AU] Australia ..... PG9864

[51] Int. Cl.[4] ..... B65D 5/60; B65D 90/04

[52] U.S. Cl. ..... 229/23 R; 220/408; 220/410; 220/441; 229/109

[58] Field of Search ..... 229/DIG. 2, DIG. 4, 229/23 A, 23 R, 109; 220/441, 462, 463, 403, 404, 408, 410; 222/105; 206/521, 597

[56] References Cited

U.S. PATENT DOCUMENTS

| | | | |
|---|---|---|---|
| 1,119,089 | 12/1914 | McMenamin | 220/403 |
| 1,376,770 | 5/1921 | Hunt | 220/441 |
| 1,550,646 | 8/1925 | Larson | 220/441 |
| 1,821,307 | 9/1931 | Howland | 229/23 A |
| 2,278,782 | 4/1942 | Harvey et al. | 220/441 |
| 3,247,999 | 4/1966 | Stilwell | 220/462 |
| 3,349,965 | 10/1967 | Krugger | 222/105 |
| 4,205,775 | 6/1980 | Swan | 229/108 |
| 4,260,071 | 4/1981 | Bamburg et al. | 229/23 R |
| 4,421,253 | 12/1983 | Crowley | 220/462 |

FOREIGN PATENT DOCUMENTS

| | | | |
|---|---|---|---|
| 538727 | 6/1955 | Belgium | 220/441 |
| 703631 | 2/1965 | Canada | 220/441 |
| 3414914 | 10/1984 | Fed. Rep. of Germany | 206/521 |
| 2354934 | 1/1978 | France | 229/23 R |
| 965221 | 7/1964 | United Kingdom | 220/441 |

*Primary Examiner*—Stephen Marcus
*Assistant Examiner*—Gary E. Elkins
*Attorney, Agent, or Firm*—Ostrolenk, Faber, Gerb & Soffen

[57] ABSTRACT

A container for bulk flowable materials in capacities greater than 500 litres, comprising a tubular inner member adapted to withstand pressure from the contained material as hoop stress in the tubular inner member and therefore to prevent bulging of the container walls, and a co-axial outer polygonal section member, the same length as, or larger than, the inner member, designed to withstand column loading from a plurality of similar containers stacked one on top of the other. The container is typically provided with end caps and a liner bag having an outlet spigot.

The outer member is preferably octagonal and constructed from multi-wall corrugated fibreboard.

20 Claims, 3 Drawing Sheets

CONTAINER FOR BULK FLOWABLE MATERIALS

This invention relates to a container for bulk flowable materials such as liquids, dry powders or granular substances, and has been devised particularly though not solely for the storage and transportation of bulk flowable materials in the "intermediate bulk" size range which refers to containers too large for man handling and yet smaller than integral purpose made road or rail tankers. Such intermediate bulk containers are designed to hold at least 500 liters of fluid and typically have capacities of 1,000 liters or more.

Because of the weight of fluid contained within an intermediate bulk container (particularly when used to contain high density fluids) severe problems are not met during either storing or transportation. For storing it is desirable to stack such containers two, three or even four layers high to achieve maximum utilization of warehouse area (or to efficiently fill a transport vehicle) which, becuase of the weight of the fluid within the containers, places a severe column loading on the lowermost container. Unless solidly reinforced, which is generally expensive and difficult to achieve during manufacture, the lowermost container can bulge under the stacking load causing possible failure of the container or a dangerous storage situation. During transportation severe dynamic loadings can be encountered, e.g. vibration loadings or impact loadings which are often found in rail switching or shunting operations, road transport and fork lift handling situations, and it is necessary for the container to be able to resist the very high pressure loadings caused by the inertia of the fluid acting on the walls of the container during impact situations. This is particularly critical in large containers having a large liquid free surface area. The government authorities in various countries lay down different testing procedures for intermediate bulk containers and various transport authorities may call for compliance with these testing procedures. For example in the U.S.A. the tests are laid down by the A.S.T.M. and similar standards authorities are set up in other countries.

In the past the requirements for the transportation and storage of bulk flowable materials have commonly been met by using metal drums, but these are very expensive to manufacture and difficult to handle in sizes greater than approximately 200 liters. Furthermore metal drums are difficult and expensive to dispose of once emptied and frequently need to be returned to the point of dispatch when empty, thus incurring very high transportation costs. Metal drums are also very expensive to clean once used and in some countries their use is forbidden unless specific provision has been made for their re-use or disposal once empty.

To overcome the problems presented by metal drums various types of intermediate bulk containers have been used in the past, for example multi-sided (polygonal) boxes formed from plywood, timber, corrugated fibreboard, etc. have been used for viscous fluids. Such containers are typified by the container shown in U.S. Pat. No. 3,937,392 (Swisher) which described a knock-down collapsible drum container assembly of generally multi-sided polygonal configuration formed from corrugated fibreboard. To resist the side wall bulging due to the pressure of the load contained within the container (particularly when stacked) it is necessary for such containers to be provided with considerable side wall reinforcement of the type shown in FIGS. 4, 5 and 6 of the Swisher patent which is of course expensive to provide during manufacture. Even when reinforced in this manner the side walls of such containers can bulge in use and frequently need to be provided with steel bands circumferentially applied around the periphery of the container of resist bulging. Similar circumferential bands of steel or tape can also be incorporated into the fibreboard walls during manufacture. Containers of the type shown in Swisher are generally used for high viscosity fluids and are not suitable for low viscosity fluids which load the container with high dynamic loading during transport impact situations. Such loadings can cause failure of the vertical seams in containers of this type.

Similar containers have been manufactured and sold by Van Leer of Essen, Belgium, one of the major suppliers of containers in the over 500 liter size range. The Van Leer "Vermatainer" is an octagonal section corrugated fibreboard container of 1,000 liter capacity mounted on a pallet and provided with a liner bag. The Vermatainer is however only suitable for viscous fluids and suffers from problems of wall bulging leading to container failure in some use situations. Van Leer also manufacture a circular section intermediate bulk container under the name "Pallbin" formed from sheet material bent into a tube and held in place by top and bottom end caps. This product resists bulging forces due to pressure loading well, but cannot be stacked, will not knock down for return and may not pass some transport authority testing.

Provision has also been made for the transportation of intermediate bulk fluids in box-type cubic containers typically having a side length of approximately one meter. Such containers typically have side walls of heavy plywood construction reinforced with steel bracing to resist the bulging forces applied by the bulk fluid within the container. These types of container are very expensive to manufacture and furthermore have a high tare weight which considerably reduces the carrying capacity and/or increases the cost of transportation. Cuboidal containers of this type can also suffer from the same disadvantages as metal drums in that they need to be cleaned and returned for reuse.

It has long been recognised that corrugated fibreboard is a relatively cheap packing material for the manufacture of containers and has many other desirable properties, e.g. the ability to be pulped or otherwise disposed of after use making the material suitable for use in the manufacture of "one trip" containers. Various attempts have been made to manufacture intermediate bulk fluid containers having a capacity of greater than 500 liters and typically of approximately 1,000 liters from corrugated fibreboard but such attempts have generally failed due to problems with side wall bulging and the failure to comply with various tests laid down by national authorities which must be met by containers used for the transportation of bulk fluids.

The present invention stems from a realisation by the inventors that for the transportation of bulk fluids (i.e. greater than 500 liters) in fibreboard containers, it is beneficial to separate the pressure load and the column load (from stacking) and to take these loads in different specialized parts of the container. This is achieved in the present invention by providing a circular section inner tubular member adapted to take the pressure load as pure hoop stress in the inner tubular member, and containing the inner tubular member within an outer member of polygonal cross section adapted to withstand column loading when a plurality of such containers are stacked one on top of the other.

Although containers of superficially similar configuration (having a circular inner member within a polygonal outer) have been proposed in the past, the designers of such containers have not realised the importance of separating the pressure and column loads and consequently such prior art containers have not been suitable for the transportation of bulk fluids in volumes exceeding 500 liters. By way of example British Pat. No. 965 221 in the name of Reed Paper Group Limited (granted in 1964) describes a small volume (5–10 gallon) container having a cylindrical fibreboard sleeve contained within an octagonal corrugated fibreboard outer. The container also incorporates an inner container in the form of a thin walled open topped cylinder of polyethylene incorporating an upper peripheral flange. The sleeve is used solely to support the rim of the flange to provide a reaction force for the flange against the closure of the cap on the container to ensure a seal between the flange and the cap of the container. Accordingly the sleeve is longer than the octagonal outer member and therefore any column loading applied to such container would be reacted by the circular inner sleeve. Should such a configuration be applied to intermediate bulk fluid containers of capacity greater than 500 liters, the sleeve would soon collapse due to the application of column loading during stacking and the container would fail as a result. There is no teaching in the Reed specification of the circular section sleeve being used to take pressure loading or of the octagonal outer being used to take column loading. In fact because the sleeve must be longer than the octagonal outer to provide support for the flange on the polyethylene inner, it is apparent that the octagonal outer does not take any column loading at all. Furthermore the configuration of the inner and the sleeve, although described as circular with reference to FIG. 1, is also described in the body of the specification as being of any other cross sectional configuration and there is therefore no teaching in Reed of the inner member being used to withstand pressure loading as pure hoop stress within a circular section inner tubular member.

Canadian Pat. No. 703 631 (issued 1965) to Pallet Devices Incorporated also describes a container having a polygonal square outer in which is contained an inner tube. The inner tube is a multi-layer corrugated fibreboard tube and the container is used for heavy articles or metal parts. This container is however not suitable for containing fluids and particularly bulk fluids in volumes exceeding 500 liters. The inner tube of multi-layer corrugated fibreboard is very expensive to manufacture and is not designed to take pressure loading of the type exerted by bulk fluids. This may be clearly seen as the tube is described as being formed in two semi-circular halves joined by gummed tape. Under the type of pressure exerted by dense fluids in volumes exceeding 500 liters the inner tube would soon fail due to treating of the gummed tape or other failure in the area of the join. Furthermore the inner tube in the Pallet Devices patent is rigid and therefore would permanently deform and fail in the type of impact testing required to be withstood by containers used for transportation of bulk fluids. In this container the column load of stacked containers is taken through the corrugated fibreboard tube and not through the outer rectangular box, i.e. there is no separation of the column and pressure loadings which is essential to the presently claimed invention. The Pallet Devices patent refers to a non-bulge container and has been configured to prevent bulging of the tubular inner member, due to the tubular shape of that member which is inherently adapted to remain "in column" during high column loading formed by stacking such containers and so to resist bulging of the side walls. This is however a different problem than that addressed by the presently claimed invention which aims to resist bulging of the container walls due to the pressure of fluids and particularly of low viscosity liquids contained within the container, even when the container is subject to intense column loading. Although the Pallet Devices container described in Canadian Pat. No. 703 631 is suitable for its expressed use of containing heavy articles such as metal parts, it is not suitable for use in containing intermediate bulk flowable materials in volumes greater than 500 liters and particularly for containing low viscosity liquids. The multi-layer corrugated fibreboard tube is adapted to resist impact of individual articles (e.g. metal parts) but not to resist pressure of bulk fluids. The multi-layer tube is a lamination of discrete, relatively weak, liners and corrugated flutes that could fail progressively layer by layer when subjected to high internal fluid pressure. There is no teaching in the Pallet Devices Canadian patent of the separation of the pressure and column loadings or of the taking of column loadings in the polygonal shaped outer member.

It is therefore an object of the present invention to provide a container for intermediate bulk flowable materials which will obviate or minimise the foregoing disadvantages or go at least part of the way toward meeting the foregoing desiderata in a simple yet effective manner, or which will at least provide the public with a useful choice.

SUMMARY OF THE INVENTION

Accordingly in one aspect the invention consists in a container for bulk flowable materials comprising an inner tubular member of substantially circular cross-section adapted to contain bulk flowable materials, and an outer member of polygonal cross-section substantially co-axially mounted about the inner member, the outer member being the same length as, or longer than, the inner member and being adapted to withstand column loading when a plurality of such containers are stacked one on top of the other.

Preferably the container has a capacity greater than 500 liters.

Preferably the outer member is octagonal or dodecagonal in cross-section.

Preferably the tubular inner member is formed from fibreboard.

When intended for use for the transportation of liquids or other low viscosity materials, the container is provided with a liner bag typically formed from flexible sheet plastics material, located within the inner tubular member.

In a further aspect the invention consists in a container for bulk flowable materials comprising an inner tubular member of substantially circular cross-section adapted to contain bulk flowable materials and an outer member of polygonal cross-section substantially co-axially mounted about the inner member, the outer member comprising a plurality of elongate rectangular panels each being connected to adjacent panels along its elongate edges, the outer member being the same length as, or longer than, the inner member and being formed from corrugated fibreboard arranged with the corrugations parallel to the elongate edges of the panels and adapted to withstand column loading when a plurality of such containers are stacked one on top of the other.

Preferably the corrugated fibreboard comprises a multi-wall board having two or more layers of corrugated sheet.

In an alternative form of the invention the outer member may be formed from two layers of corrugated fibreboard nesting one within the other.

In a still further aspect the invention consists in a container for bulk flowable materials comprising an inner tubular member of substantially circular cross-section adapted to contain bulk flowable materials by the provision of a liner bag therein, and an outer member of polygonal cross-section substantially co-axially mounted about the inner member, the outer member comprising a plurality of elongate panels, each being connected to adjacent panels along its elongate edges, the outer member being the same length as, or longer than, the inner member and being adapted to withstand column loading when a plurality of such containers are stacked one on top of the other, the container being provided with removable end caps adapted to engage either end of the outer member, and wherein flaps are provided at the lower edge of each panel, folded inwardly and located between the bottom end cap and the liner bag.

Preferably the bottom end cap is in the form of a pallet base adapted for handling by a fork lift truck.

Alternatively the bottom end cap comprises a flanged corrugated fibreboard end cap supported in turn by a pallet base beneath the bottom end cap.

BRIEF DESCRIPTION OF THE DRAWINGS

Notwithstanding any other forms that may fall within its scope, one preferred form of the invention will now be described by way of example only with reference to the accompanying drawings, in which.

DETAILED DESCRIPTION

In the preferred form of the invention a container for bulk flowable materials of the type generally described above is constructed from various forms of fibreboard although it will be appreciated that the container could be constructed from other alternative materials. In this specification the term "fibreboard" is used to refer to comparatively heavy weight and tough fibrous sheet material generally heavier and/or tougher than paper or card, and the term "corrugated fibreboard" is used to refer to laminations of fibreboard material wherein two or more liner sheets are lamintated with at least one sheet of fibreboard formed into fluted corrugations. Although such materials are commonly referred to in many territories as corrugated fibreboard, they are referred to in other territories by other names such as corrugated cardboard. Corrugated fibreboard may be either single layer board having a single corrugated sheet laminated between two plain liners or various forms of multi-wall board having two, three or more layers of corrugated sheet each separated by, and faced by, liner sheets.

Figure 4:
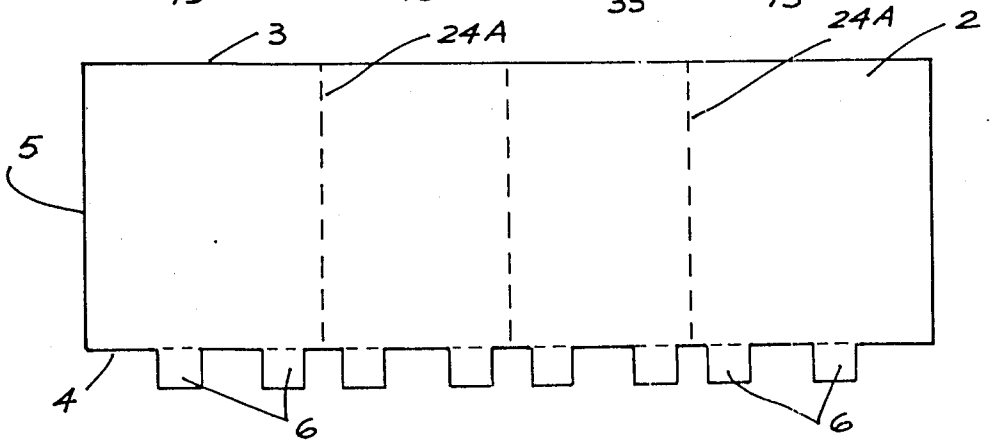
FIG. 4 is a plan view of a blank from which the inner tubular member of the container may be formed.

The container comprises an inner tubular member (1) of substantially circular cross-section typically formed from solid fibreboard material such as that shown in blank form at (2) in FIG. 4. The blank has top and bottom edges (3) and (4) respectively forming the upper and lower rims of the inner tubular member, and ends (5) which are typically lapped and fastened together, e.g. by gluing. The inner tubular member may also be provided with flaps (6) on its lower edge (4) which are folded inwardly and utilised as will be described further below. Although the inner member is preferably formed from solid fibreboard material it will be appreciated that other materials capable of taking hoop stress imposed by bulk fluids contained therein may be used. For example the inner member could be formed by bending thin wall sheet steel into a tubular configuration.

The inner tubular member (1) sits within an outer member (7) of polygonal cross-section substantially co-axially mounted about the inner member and typically of octagonal cross-section as shown in the accompanying drawings. The outer member may, however, be of any desired polygonal cross-section (e.g. square or hexagonal) although it is preferably octagonal or dedecagonal (twelve sided). The outer member comprises a plurality of elongate rectangular panels (8), each being connected to adjacent panels along its elongate edges (9). The comparative sizes of the inner tubular member and the outer polygonal member are such that the inner tubular member touches the interior surface of each panel at or about a line midway between the elongate edges of the respective panel.

The outer member is the same length as, or longer than, the inner member so that when a number of containers are stacked one on top of the other, the stacking loads are transmitted downwardly through the outer members. Typically the inner member would be between 0 and 12 mm shorter than the outer member, the main criterion being that the upper edge of the inner member should be above the surface of fluid within the container in use. The inner member could of course be considerably shorter than the outer member and the gap above the inner member could be filled in with a pad, an air bag, or other packing material to prevent the container fluid from flowing over the top of the inner member. For efficient packing it is however preferred to keep the inner member the same length as, or slightly shorter than, the outer member.

Figure 3:
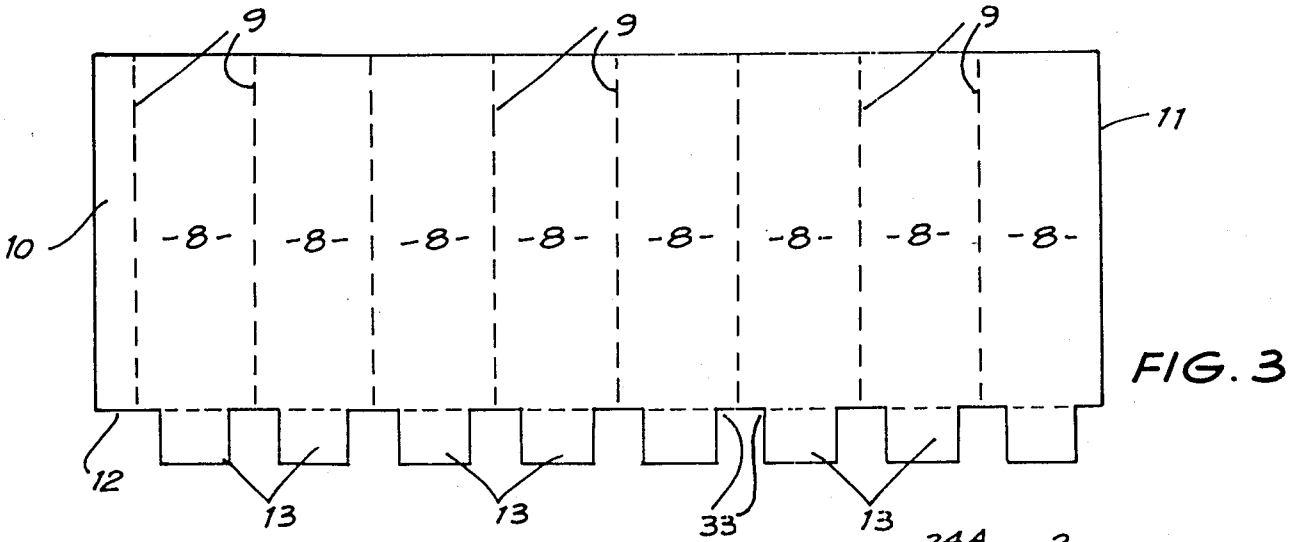
FIG. 3 is a plan view of a blank from which the outer member of the container may be formed.

The outer member may conveniently be formed from a blank of sheet material of the configuration shown in FIG. 3 which is bent or folded along parallel lines (9) which form the elongate edges of the panels. One end (10) of the blank may be provided with a tab which is overlapped with the opposite end (11) and fastened in place, e.g. by gluing or stitching to form the completed octagonal section outer member.

The lower edge (12) of each panel (8) may be provided with a flap (13) adapted to be folded inwardly to form an inward facing flange around the lower edge of the outer member as will be described further below.

The outer member is preferably formed from corrugated fibreboard arranged with the corrugations parallel to the elongate edges of the panels (8) so that the outer member is adapted to withstand column loading when a plurality of such containers are stacked one on top of the other. To this end the outer member is the same length as, or slightly longer than, the inner member (1) so that column loads are transmitted into and through the outer member (7) for light weight applications the outer member may be formed from a single layer of single wall corrugated fibreboard, but for heavier duty applications the outer member may be formed from multi-wall fibreboard, typically from double wall or triple wall corrugated fibreboard. It has been found that triple wall fibreboard is particularly suitable for the formation of the outer member for large containers required for containing heavy bulk flowable materials.

Figure 2:
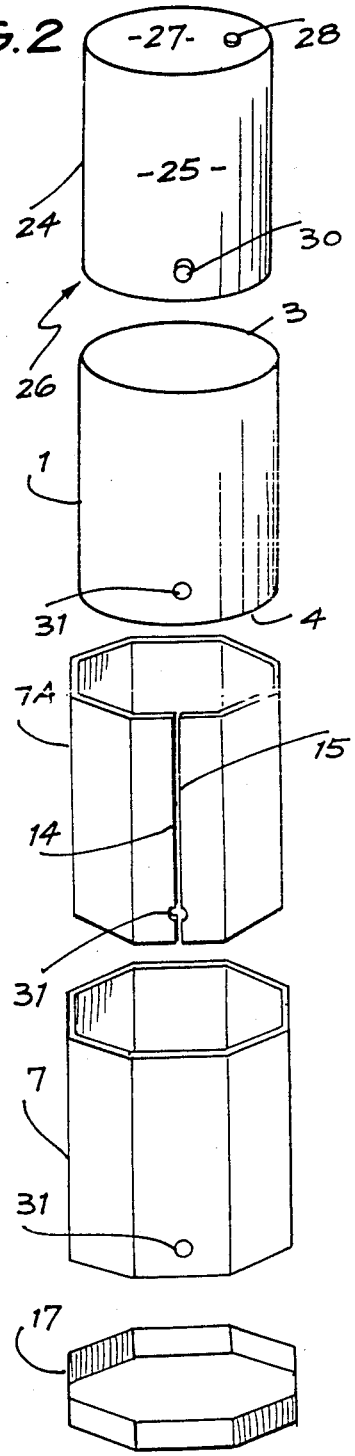
FIG. 2 is an exploded view of the container shown in FIG. 1 (without the upper end cap)

In an alternative form of the invention the outer member (7) may be formed from two components by providing a sleeve (7A) of similar configuration to (but slightly smaller than) the outer member (7). In this manner the sleeve (7A) is adapted to nest neatly within the outer member (7), forming an outer member of double thickness. The sleeve (7A) may be formed from a similar blank to that shown in FIG. 3 but without the end flap (10) or the bottom flaps (13). The edges (14) and (15) of the blank from which the sleeve is formed may be simply abutted in the middle of a panel as can be seen in FIG. 2. Using the sleeve (7A), and forming both the outer member (7) and the sleeve (7A) from double wall or triple wall corrugated fibreboard it is possible to form a container which will withstand loadings from very dense bulk flowable materials in very large containers.

In a further form of the invention, part of the column loading could be taken by elongate struts (32) inserted into the container in the voids between the inner and outer members. Such struts could typically be triangular section wooden struts, metal angle struts, or could be folded up from corrugated fibreboard.

Figure 5:
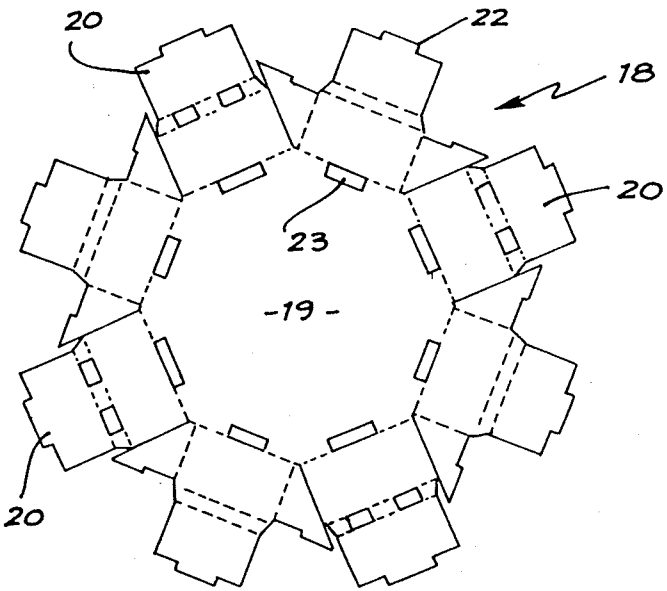
FIG. 5 is a plan view of a blank from which an end cap for the container may be formed.

The top and bottom of the container are closed by end caps in the form of a top end cap (16) and a bottom end cap (17) respectively. The end caps may be formed from any material in any convenient form but are preferably formed by folding a blank of corrugated fibreboard of the general configuration shown in FIG. 5. The blank (18) has a central planar portion (19) formed to the general configuration of the outer member, e.g. to an octagon, and is provided with flap portions (20) which can be folded along the dotted lines shown to form a downwardly depending side wall (21) which may conveniently be held in place by tabs (22) inserted into slots (23) etc.

Figure 1:
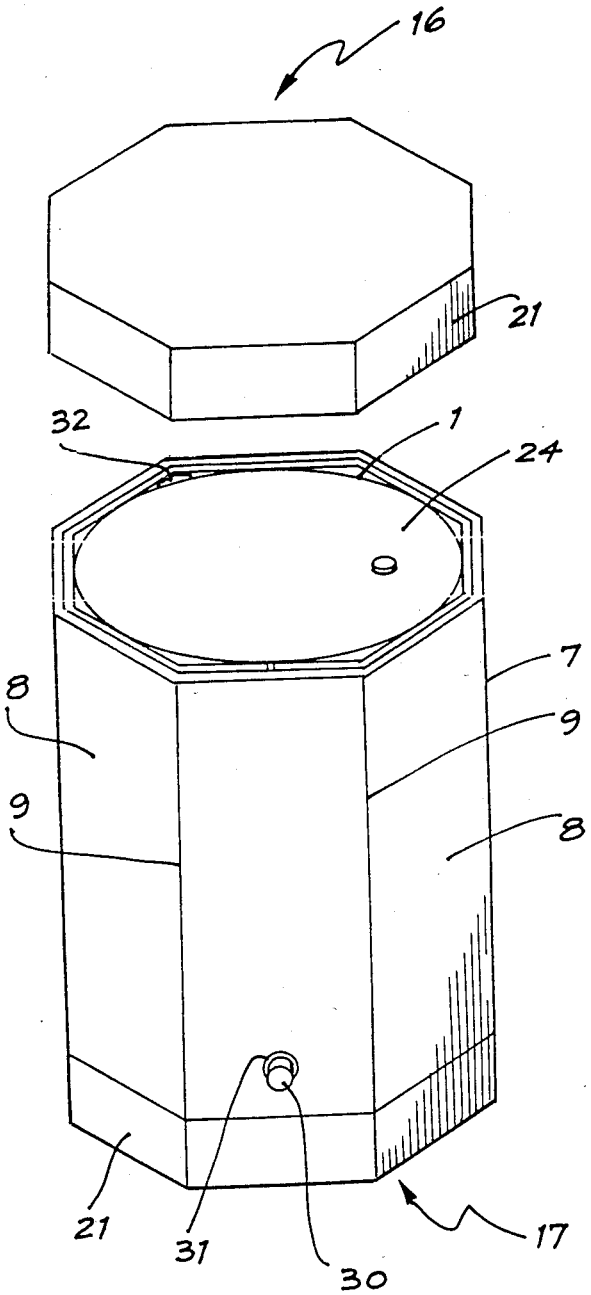
FIG. 1 is a perspective view of a container for bulk flowable materials according to the invention, with the upper end cap displaced for clarity.

Although the container shown in FIGS. 1 and 2 is provided with both a top end cap (16) and a bottom end cap (17), it will be appreciated that one or more of the end caps may take other forms. For example, it is common to use the container with a pallet and the lower end cap (17) may be replaced by the pallet such that the outer member (7) and the inner tubular member (1) are seated directly on the upper surface of the pallet and fastened thereto by suitable attachment means. Alternatively the bottom end cap may be similar to the top end cap and simply sit on top of the pallet. In a further alternative, the bottom end of the container may be enclosed by providing fold-in flaps on the outer member, of the type shown at (13) but enlarged in size and shaped to interlock to form a bottom surface to the container. These flaps could be held in place by stitching or gluing if required.

Where the container is to be used for granular solids, powders, or other materials of this kind, the material may be simply inserted within the confines of the inner tubular member (1). When the container is to be used with liquids or similar low viscosity materials, the container is provided with a liner bag (24) which may be formed from any suitable material but which is preferably fabricated from a flexible sheet plastics material. It is also preferred that the liner bag (24) be preformed into a cylindrical shape corresponding to the size of the inner tubular member (1), such that the liner bag has a circumferential side wall (25) and end walls (26) and (27). The liner bag is also conveniently provided with a filling aperture (28). For certain applications the liner bag may also be provided with a dispensing tap or other opening (not shown) placed either low down in the circumferential wall (25) and protruding from the container through suitable aligned apertures formed in the inner and outer members, or placed in the bottom of the bag for bottom discharge.

The dispensing tap or valve is typically mounted in a spigot (30) protruding from the circumferential wall (25) of the liner bag and which extends through aligned apertures (31) in the various inner and outer members. It is desirable to form the apertures (31) larger in diameter than the spigot (30) and preferable to line the gap between the edges of the aligned apertures and the spigot with a shock absorbing material such as expanded foam plastics material or the like. In this way any vibration of the container in transit, or any relative movement of the members (1), (7) or (7A) is not directly transmitted to the spigot which could otherwise cause stress in the spigot and possible failure of the liner bag in the area of the spigot. Similarly any vibration of the spigot is not transmitted to the adjacent container walls, so avoiding potential damage and failure of the walls in that area.

It is a particular feature of the container according to the invention that the inner member (1) may be filled with a bulk flowable material without causing bulging of the sides of the container. This is due to the circular cross-section of the inner member which transmits the pressure from the fluid load purely into hoop stress in the wall of the inner member, inherently resisting any bulging. Although the inner member on its own would not be sufficiently strong to take the lateral loads, impact loading, and column loading of further heavy containers stacked on top of one another, this is unnecessary as these loadings are taken largely through the outer member (7) (optionally in conjunction with the sleeve (7A) or the struts (32)). To this end the corrugated fibreboard outer member is inherently adapted to take large axial loadings in the direction of the corrugations, which are only slightly weakened by the folds or scores at the elongate edges (9).

It is a further feature of the invention that the container, when empty, can be folded into a flat configuration for transportion or storage. This can be achieved simply be removing the end caps (16) and (17) and flattening the remainder of the container about convenient fold lines. If required the inner member (1) can be provided with pre-scored fold lines (24A) (FIG. 4) to assist in folding the inner member to a flattened configuration. When required for use the container is simply opened out to the octagonal shape which is accurately defined by the end caps or by interlocking of the bottom flaps. Where desired to achieve the exact shape an octagonal piece of corrugated fibreboard (not shown) cut to the internal size of the outer member may be simply inserted into the outer member before erection of the various components. Once filled with fluid, the pressure within the inner member is taken as hoop stress therein, forcing the inner member into the circular shape inherently adapted to resist the pressure without bulging. The container may be folded flat either in its entirety (with the end caps removed) or may be broken down into its various components for folding and storage.

When the container is fabricated the end flats (13) on the outer member (7) (and/or the similar end flaps (6) on the inner member (1)) form an inwardly facing flange at the base of the container. The liner bag (24) sits on top of this flange so that the weight of the bulk flowable material container within the liner bag acts downwardly on the flange and holds the inner and outer members securely in place against the end caps (17) (or against an equivalent pallet base). The inwardly facing flange formed by the flaps (13) is also important in preventing the inner and/or outer members from "riding up" during vibration or other movement during transportation. Without this feature there could be a tendancy for the outer and/or inner members to ride up allowing the liner bag (24) to bulge out beneath the inner or outer member causing a weakening in the pessure containing capability of the container and furthermore providing a point at which the liner bag could be pinched by the lower edges of the inner and/or outer members and fractured causing a leak. The provision of the flaps (13) (and/or (6)) provide a simple yet effective solution to this problem.

In the construction of the container the inner and outer members are typically of the same length but it will be appreciated that the outer member (which takes the column loading during stacking) could be slightly longer than the inner member (1).

Figure 6:
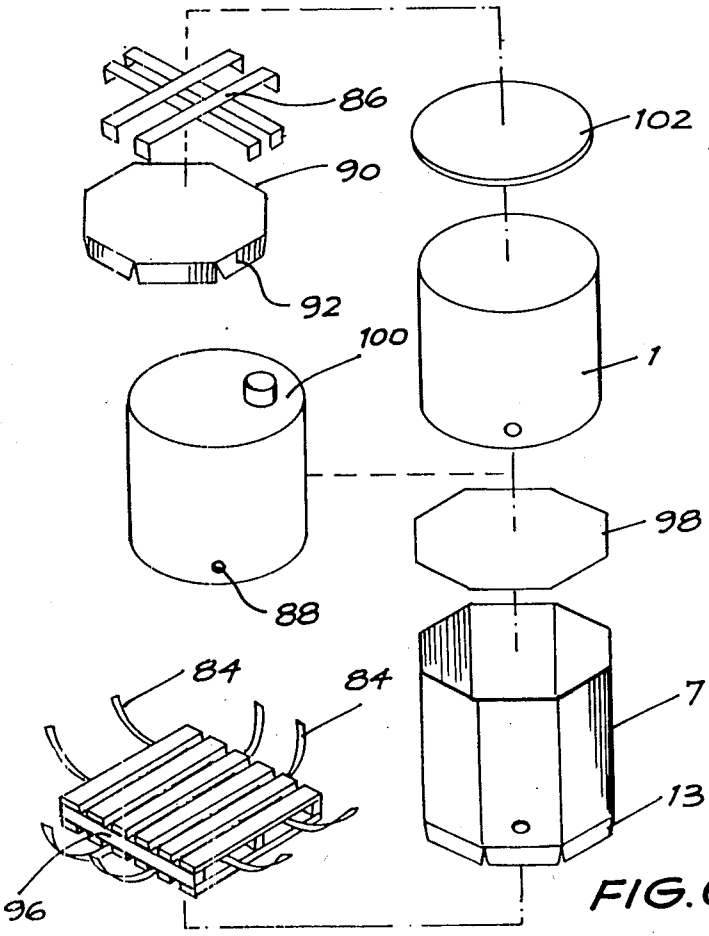
FIG. 6 is an exploded schematic view, in perspective, illustrating a shipping assembly embodying the invention.

FIG. 6 illustrates a shipping assembly in accordance with the invention on a pallet base. A separate pallet (96) of conventional construction is employed beneath the shipping container to facilitate movement of the containers by a fork lift or hand lift truck.

A bottom pad (98) is preferably inserted into the outer sleeve (14) and rests upon the infolded end flaps (13). The bottom pad (98), in the illustrated embodiment, has an octagonal-shaped cross section and is designed to be closely received within the outer sleeve (7). The peripheral edges of the bottom pad (98) bear against the side walls of the outer sleeve (7). The bottom pad (98) is preferably composed of triple wall corrugated fibreboard.

A plastic liner bag (100) is preferably provided within the inner sleeve (1) to leak-proof the container. The liner bag (100) precludes the flow of the contained materials between the interstices that may exist in between the end flaps and at the bottom pad. A suitable liner bag (100) can be made from a flexible plastic film material, such as polyethylene extruded film or the like.

In certain applications, a compressible top pad (102) with a circular cross section may be provided as a filler to fill any head space or void area that may exist or occur, for example, due to incomplete filling, settling, or contraction of the contained material, between the liner bag 100 and the end cap (90). The top pad (102) is particularly suited for applications in which a liquid is contained as it prevents, or at least helps to reduce, the harmful sloshing or surging of the liquid which tends to occur during transportation due to large free surface area. However, the compressibility of the top pad (102) still allows expansion of the liquid, thereby releasing some of the hydrostatic or hydraulic pressures which would otherwise be exerted against the sidewalls and end caps of the container. The periphery of the top pad bears against the inner surface of the inner sleeve (1). The top pad (102) can also be formed by an air bag located between the liner bag (100) and the end cap (90). When used with low viscosity fluids, the air bag preferably has a plurality of downwardly extending protrusions which unevenly deform the upper surface of the liner bag (100) and break up the free surface area of the liquid in the liner bag, inhibiting sloshing or surging of the liquid therein. Alternatively baffles can be provided within the upper region of the liner bag (100).

Steel strapping (84) is employed to hold the shipping containers to the pallet (96). In order to avoid damage to the end cap (90), inverted U-shaped strapping braces (86) are mounted across the end cap (90) intermediate of both the upper surface and said flanges (92) of the end cap and the strapping (84). Each strapping brace (86) consists of a flattened central elongated plate and depending legs designed to overlie the top surface and flanges (92), respectively, of the end cap. The braces (86) are provided with a greater width than the strapping (84) in order to more evenly distribute the strap forces over the shipping container. The braces are also the same length as the width of the end cap to prevent any compressive loading from the straps distorting the end cap and the circular sectional shape of the inner sleeve (1). When the strapping braces (86) are tightened down by the strapping (84), the inner sleeve (12) is positively seated against the bottom pad (98) to further stabilize the contained load. The end flaps are held in place by the weight of the contained materials pressing down on the bottom pad and, in conjunction with the pressure of the strapping, provide a strengthening or resistance to lateral deflection at the bottom of the outer sleeve (7), which is the area that is most vulnerable to buckling.

A bottom spout fitment or spigot (88) is provided extending through the outer sleeve and the inner sleeve to allow gravity evacuation of the material contained within the liner bag (100). The spigot extends through apertures formed through the walls of the inner and outer sleeves.

A number of containers constructed according to the invention were tested by the National Materials Handling Bureau (N.M.H.B.) of the Australian Commonwealth Government Department of Industry, Technology and Commerce based on tests laid down in U.S.A., A.S.T.M. Standard D-4169 over a number of different tests described below.

The sample tested had an octagonal outer sleeve (7) formed from triple wall corrugated fibreboard of Beech Puncture 1450 units with short base flaps and an octagonal liner sleeve (7A) of the same material. The inner tubular member (1) was formed from solid fibre Hydrokraft Liners Grammage minimum 1200 g.s.m. with short base flaps (6) mounted on an octagonal base pad (98) formed from triple wall corrugated fibreboard Beech Puncture 1250 units and mounted on a standard Australian hire system pallet. The container was provided with a cylindrical liner bag of Valeron 150 micron film with a top filling neck and the top cap was formed from No. 1 board single wall die cut corrugated fibreboard. The container was secured to the pallet by way of a 14 gauge four-way strapping frame placed over the upper end cap and secured to the pallet with metal strapping (Super Strap 19 mm×0.63 mm).

The sample was filled with 880 liters of water and tested to Assurance Level 2 requirements (based on A.S.T.M. tests), with failure citeria being either leakage or structural failure allowing the liner bag to fall out.

TEST PROCEDURES

A. Mechanical Handling Drop Test:

The specimen was placed with one of the pallet entry boards on a 150 mm (six inch) wooden block. The opposite side was raised 150 mm (six inches) off the concrete floor by means of a fork lift truck, using plastic sheeting on each fork tyne to reduce friction. The fork truck was reversed, causing the pallet edge to drop onto the floor. This procedure was repeated with the pallet in the same orientation; it was then rotated through 180 degrees and a further two drops conducted.

B. Rotary Loose-Load Vibration:

After the mechanical handling drop tests the specimen was placed (loose) on the table of a vibration tester, with a 25 mm (one inch) displacement, set for rotary motion and vibrated at 235 rpm (approximately 0.8G peak vertical acceleration) for 20 minutes. The specimen was removed and nailed to a second pallet to enable it to be repositioned on the table rotated through 90 degrees. The specimen was then vibrated at 235 rpm for a further 20 minutes.

C. Vertical Linear Vibration:

The second pallet used in the rotary vibration test was removed and the specimen repositioned on the vibration table after it had been reset for vertical linear vibration. Wooden blocks were placed around the pallet to restrict horizontal movement. The specimen was vibrated at 260 rpm (1.0G peak acceleration) for 40 minutes.

D. Simulated Rail Switching - Inclined Impact Test:

Following the vibration testing the specimen was placed on the dolly of an inclined impact tester. The pallet edge was lined up with the impact face of the dolly so as to impact onto the fixed bulkhead. The specimen was then subjected to three impacts, the first at 1.8 m/s (4 mph) and the second and third at 2.7 m/s (6 mph). Shock duration and intensity were not recorded and no backload was used (limited dolly area). The specimen used for tests A to D was not conditioned prior to testing.

E. Compression Test:

Another specimen was conditioned for more than 72 hours at 32+1° C. and 90+5% relative humidity. The specimen was then removed from the conditioning room and placed in a compression testing machine, with fixed upper platen and floating lower platen. The specimen was loaded at approximately 30 kN/minute to failure.

TEST RESULTS

All the above specified tests were passed without leakage or without structural failure (allowing the liner beg to fall out). The test results show that a bulk fluid container constructed according to the present invention is suitable for the safe transportation of intermediate bulk fluids in volumes in excess of 500 liters. Prior art containers of the type referred to in the introductory portions of this specification have particular difficulty in meeting the requirements of Test D - the Inclined Impact Test, which was complied with by the sample according to the invention without leakage. Observation of the Inclined Impact Test shows that the container distorts on impact into the fixed bulkhead and the distortion causes an upward surge within the fluid which can damage the top end cap. Such damage does not however result in failure of the container and it is felt that the inherent flexibility of the container enables the integrity of the container to be maintained. To this end it is desirable that the container (both the outer octagonal sleeve and the inner circular sleeve) be able to flex during impact, to absorb that impact and then to return to the original configuration. To this end the flexible circular inner sleeve of solid fibreboard material inherently reverts to a circular section after impact due to the pressure of the fluid therein. It is felt that the flexibility of the inner circular section sleeve enables the container to comply with this testing requirement, whereas a rigid inner sleeve would deform upon impact causing distortion and possible failure of the container. It is also felt that the flexible nature of the upper end cap assists in the absorbtion of inertial surge in the liquid (particularly for low viscosity liquids) and that the performance of the container would be inferior if provided with a solid or rigid top end cap without any internal compressive material.

It was also found from the testing that the fit of the solid fibre inner sleeve within the octagonal outer must be good and that the sleeve must touch the inner walls of the octagonal outer sleeve at point or near point contact. If the inner tubular member is too large the flat area of contact with the flat walls of the octagonal outer member causes pressure to be transmitted to the panels of the octagonal outer and if the inner is too small it will move excessively causing excessive pressure on the octagonal panels.

The tests have shown that by realising the benefits of isolating the pressure loading from bulk flowable materials (and resisting that pressure in pure hoop stress in a circular section inner member) from the column loading taken by a polygonal outer shaped outer member, it has been possible to construct a bulk fluid container capable of containing bulk flowable materials (including liquids) in volumes in excess of 500 liters which is cheap and simple to manufacture from low cost fibreboard materials while yet being able to meet column loading requirements imposed by stacking and also dynamic loading requirements which may be imposed during transportation and handling.

What we claim is:

1. A container capable of holding over 500 liters of bulk flowable materials comprising an inner tubular member of substantially circular cross-section made of a material adapted to contain bulk flowable materials and to withstand an amount of hoop stress exertable by a bulk flowable material present at or near the volume capacity of said container, the inner tubular member being flexibly deformable in a radial direction when subjected to a distorting force, yet capable of regaining its original configuration after said distorting force is removed, and an outer member of polygonal cross-section substantially co-axially mounted about the inner member, the outer member being the same length as, or longer than, the inner member and being made of a material adapted to withstand column loading when a plurality of such containers are stacked one on top of the other.

2. A container as claimed in claim 1 wherein the outer member comprises a plurality of elongate rectangular panels, each being connected to adjacent panels along its elongate edges, the inner tubular member touching each panel at or about a line midway between the elongate edges of the respective panel.

3. A container as claimed in claim 2 wherein the panels are formed from a continuous length of sheet material bent or folded along parallel lines which form the elongate edges of the panels.

4. A container as claimed in claim 1 further comprising removable end caps.

5. A container as claimed in claim 4 wherein at least the top end cap is formed from corrugated fibreboard having a central planar portion of substantially the same configuration as the cross-section of the outer member and a peripheral flange extending downwardly from the central portion adapted to nest around the outer periphery of the outer member.

6. A container as claimed in claim 1 wherein the outer member has an octagonal cross-section.

7. A container as claimed in claim 1 wherein the outer member has a dodecagonal cross-section.

8. A container as claimed in claim 1 wherein the tubular inner member is formed from fibreboard.

9. A container as claimed in claim 1 further comprising a liner bag located within the inner tubular member.

10. A container as claimed in claim 9 wherein the liner bag is formed from flexible sheet plastics material.

11. A container as claimed in claim 9 wherein the liner bag has a generally cylindrical configuration with closed upper and lower ends and a filling opening in the upper end.

12. A container as claimed in claim 1 wherein the outer member is between 0 and 12 millimeters longer than the inner member.

13. A container as claimed in claim 9 wherein the liner bag is provided with an outlet spigot protruding through aligned apertures in the inner and outer members, and wherein the aligned apertures are larger than the spigot forming a clearance gap around the periphery of the spigot.

14. A container as claimed in claim 13 wherein the clearance gap is filled with a compressible shock absorbing material.

15. A container capable of holding over 500 liters of bulk flowable materials comprising an inner tubular member of substantially circular cross-section made of a material adapted to contain bulk flowable materials by the provision of a liner bag therein, said inner tubular member being capable of withstanding an amount of hoop stress exertable by a bulk flowable material present at or near the volume capacity of said container and being flexibly deformable in a radial direction when subjected to a distorting force, yet capable of regaining its original configuration after said distorting force is removed, and an outer member of polygonal cross-section substantially co-axially mounted about the inner member, the outer member comprising a plurality of elongate panels, each being connected to adjacent panels along its elongate edges, the outer member being the same length as, or longer than, the inner member and being made of a material adapted to withstand column loading when a plurality of such containers are stacked one on top of the other, the container being provided with removable end caps engaging either end of the outer member, and wherein flaps are provided at the lower edge of each panel, folded inwardly and located between the bottom end cap and the liner bag.

16. A container capable of holding over 500 liters of bulk flowable materials comprising an inner tubular member of substantially circular cross-section made of a material adapted to contain bulk flowable materials and to withstand an amount of hoop stress exertable by a bulk flowable material present at or near the volume capacity of said container, the inner tubular member being flexibly deformable in a radial direction when subjected to a temporary distorting force, yet capable of regaining its original configuration after said distorting force is removed, and an outer member of polygonal cross-section substantially co-axially mounted about the inner member, the outer member being the same length as, or longer than, the inner member, and a plurality of elongate struts arranged between the inner and outer members, made of a material adapted to withstand column loading when a plurality of such containers are stacked one on top of the other.

17. A container capable of holding over 500 liters of bulk flowable materials comprising an inner tubular member of substantially circular cross-section made of a material adapted to contain bulk flowable materials and to withstand an amount of hoop stress exertable by a bulk flowable material present at or near the volume capacity of said container, the inner tubular member being flexibly deformable in a radial direction when subjected to a distorting force, yet capable of regaining its original configuration after said distorting force is removed, and an outer member of polygonal cross-section substantially co-axially mounted about the inner member, the outer member comprising a plurality of elongate rectangular panels each being connected to adjacent panels along its elongate edges, the outer member being the same length as, or longer than, the inner member and being formed from corrugated fibreboard arranged with the corrugations parallel to the elongate edges of the panels made of a material adapted to withstand column loading when a plurality of such containers are stacked one on top of the other.

18. A container as claimed in claim 17 wherein the corrugated fibreboard comprises a multi-wall board having two or more layers of corrugated sheet.

19. A container as claimed in claim 17 wherein the corrugated fibreboard comprises a triple wall corrugated fibreboard.

20. A container as claimed in claim 17 wherein the outer member is formed from two layers of corrugated fibreboard nested one within the other.

* * * * *